US006887638B2

(12) United States Patent
Ishiyama et al.

(10) Patent No.: US 6,887,638 B2
(45) Date of Patent: May 3, 2005

(54) TONER FOR DEVELOPING ELECTROSTATIC LATENT IMAGE, PROCESS FOR PRODUCING THE SAME, PROCESS FOR FORMING IMAGE, APPARATUS FOR FORMING IMAGE AND TONER CARTRIDGE

(75) Inventors: Takao Ishiyama, Minamiashigara (JP); Shuji Sato, Minamiashigara (JP); Hiroshi Kamada, Minamiashigara (JP); Masakazu Iijima, Minamiashigara (JP)

(73) Assignee: Fuji Xoerox Co., Ltd., Tokyo (JP)

( * ) Notice: Subject to any disclaimer, the term of this patent is extended or adjusted under 35 U.S.C. 154(b) by 69 days.

(21) Appl. No.: 10/414,201

(22) Filed: Apr. 16, 2003

(65) Prior Publication Data

US 2004/0058267 A1 Mar. 25, 2004

(30) Foreign Application Priority Data

Sep. 20, 2002 (JP) ..... 2002-276098

(51) Int. Cl.[7] ..... G03G 9/093

(52) U.S. Cl. ..... 430/110.2; 430/110.4; 430/111.4; 430/137.11; 430/137.14

(58) Field of Search ..... 430/110.2, 110.4, 430/111.4, 137.11, 137.14, 110.3, 108.8

(56) References Cited

U.S. PATENT DOCUMENTS

| | | | | |
|---|---|---|---|---|
| 5,346,797 | A | 9/1994 | Kmiecik-Lawrynowicz et al. | |
| 2001/0033984 | A1 * | 10/2001 | Matsumura et al. | 430/110.4 |
| 2003/0022084 | A1 * | 1/2003 | Sugiyama et al. | 430/108.1 |
| 2004/0053155 | A1 * | 3/2004 | Emoto et al. | 430/137.15 |

FOREIGN PATENT DOCUMENTS

| | | |
|---|---|---|
| JP | A 63-282752 | 11/1988 |
| JP | A 6-250439 | 9/1994 |

* cited by examiner

*Primary Examiner*—John L Goodrow
(74) *Attorney, Agent, or Firm*—Oliff & Berridge, PLC

(57) ABSTRACT

A toner for developing an electrostatic latent image is provided that is excellent in releasing property upon fixing and shape controllability upon production of the toner. The toner for developing electrostatic latent image has a number average molecular weight in a range of from 10,000 to 30,000 and a ratio of a Z average molecular weight and a weight average molecular weight in a range of from 3.0 to 6.0.

22 Claims, 1 Drawing Sheet

TONER FOR DEVELOPING ELECTROSTATIC LATENT IMAGE, PROCESS FOR PRODUCING THE SAME, PROCESS FOR FORMING IMAGE, APPARATUS FOR FORMING IMAGE AND TONER CARTRIDGE

BACKGROUND OF THE INVENTION

1. Field of the Invention

The present invention relates to a toner for developing electrostatic latent image used upon developing an electrostatic latent image, which is formed by an electrophotographic method or an electrostaic recording method, with a developer, and a process for producing the same, and it also relates to a process for forming an image, an apparatus for forming an image and a toner cartridge, which use the toner for developing electrostatic latent image.

2. Description of the Related Art

A process for visualizing image information through an electrostatic image, such as an electrophotographic process, is being widely applied to various fields. In the electrophotographic process, after uniformly charging a surface of a photoreceptor, an electrostatic image is formed on the surface of the photoreceptor, the electrostatic latent image is visualized as a toner image through development with a developer containing a toner, and the toner image is transferred and fixed to a surface of a recording medium to form an image.

As the developer used herein, a two-component developer containing a toner and a carrier, and a one-component developer using a magnetic toner or a non-magnetic toner solely have been known. The toner used in the developers is generally produced by a kneading and pulverizing method, in which a thermoplastic resin is melted and kneaded with a pigment, a charge controlling agent and a releasing agent, such as wax, and after cooling, it is finely pulverized and classified. In the production of the toner, fine particles of an inorganic material and/or an organic material may be added to the surface of the toner particles depending on necessity for improving the flowability and the cleaning property. While the production process of the toner can provide an excellent toner, it involves several problems described below.

The shape and the surface structure of the toner produced by the ordinary kneading and pulverizing method are irregular, and the shape and the surface structure of the toner cannot be intentionally controlled while they are delicately changed by the pulverization property of the materials used and the conditions for the pulverizing step. Furthermore, in the kneading and pulverizing method, there is a limitation in selection of materials used for producing a toner. Specifically, it is necessary that a resin colorant dispersion used as the material is sufficiently brittle and is capable of being finely pulverized by a production apparatus that can be employed under the economical circumstances. However, when the resin colorant dispersion is made brittle to satisfy the demand, there are some cases where further fine powder is formed, and the shape of the toner is changed, by a mechanical shearing force applied in a developing device. Due to the phenomenon, the fine powder is firmly fixed on the surface of the carrier to accelerate deterioration of charge of the developer in the two-component developer. In the one-component, there are some cases where the particle size distribution of the toner is broadened to cause scattering of the toner, and the development property is lowered by the change of the shape of the toner to deteriorate image quality.

In the case where a large amount of a releasing agent, such as wax, is internally added to form a toner, the releasing agent is liable to be exposed on the surface of the toner depending on the combination with the thermoplastic resin. Particularly, in the case where the toner is produced with a combination of a resin with its elasticity increased that is slightly difficult to be pulverized due to a high molecular weight component with brittle wax, such as polyethylene, exposure of the polyethylene is often observed on the surface of the toner. In this case, although it is advantageous to the releasing property on fixing and to cleaning of a non-transferred toner remaining on the surface of a photoreceptor, the polyethylene exposed on the surface of the toner easily migrates to other members with a mechanical force, whereby the developing roll, the photoreceptor and the carrier are liable to be contaminated to bring about decrease in reliability.

Furthermore, there are cases where a flowability assistant is added to suppress decrease in flowability due to the irregular shape of the toner. In this case, however, there are some cases where sufficient flowability of the toner cannot be obtained, and the fine particles of the flowability agent added to the sure of the toner migrate to concave parts on the toner with a mechanical shearing force upon forming an image to lower the flowability with a lapse of time and to bury the flowability agent into the toner, whereby the development property, the transfer property and the cleaning property are deteriorated. The image quality is liable to be lowered when a toner recovered by cleaning is returned to the developing device for reusing. In the case where the amount of the flowability agent added to the surface of the toner is increased in order to avoid the problem, black spots are formed on a photoreceptor, and the fine particles of the flowability agent are scattered.

In recent years, a process for preparing a toner by an emulsion polymerization and aggregation method is proposed as a method enabling intentional control of a shape and a surface structure of a toner (as described, for example, in JP-A-63-282752 and JP-A-6-250439). In the production process of a toner, generally, a resin fine particle dispersion produced by emulsion polymerization and a colorant particle dispersion produced by dispersing a colorant in a solvent are at least mixed to form aggregates having a diameter corresponding to a particle diameter of a toner, and the aggregates are coalesced by heating to form a toner. The production process of a toner not only realizes decrease in particle diameter of the toner, but also such a toner can be obtained that is considerably excellent in particle size distribution.

Furthermore, in recent years, there is remarkable tendency to decrease a diameter of a toner for realizing a high-definition image upon forming a color image associated with an increasing demand for high image quality. However, in the case where the diameter of the toner is simply decreased with maintaining the conventional particle size distribution, the problems caused by contamination of a carrier and a photoreceptor and scattering of the toner caused by the presence of a toner fraction on the small diameter side in the particle size distribution become serious, and therefore, it is difficult that the high image quality and the high reliability are simultaneously realized. Accordingly, it is also necessary that the particle size distribution is narrowed, and simultaneously, the particle diameter is decreased. The production process of a toner utilizing the emulsion polymerization and aggregation method is advantageous from this standpoint.

A toner is being required, in recent years, to have a low temperature fixing property to attain a high-speed operation and energy saving, which are demanded by the use of digital equipments and improvement in productivity of office documents. From the point of view, a toner produced by the emulsion polymerization and aggregation method has excellent characteristics in low temperature fixing property owing to the narrow particle size distribution and the small particle diameter.

In order to assure the releasing property upon flying, in addition to the low temperature fixing property, a surface of a member in contact with a toner image, such as a fixing roll, is coated with a fluorine resin film, such as polytetrafluoroethylene, to decrease the surface energy thereof.

However, in the case where the surface of the fixing roll is heated with a heat source incorporated in the fixing roll, there are some cases where effective thermal conduction from the heat source to the surface of the fixing roll is impaired by the fluorine resin film. Therefore, there is a limitation of the thickness of the fluorine resin film provided on the surface of the fixing roll. In the case where the thickness of the fluorine resin film is decreased to accomplish effective thermal conduction, the low wetting property on the surface of the fixing roll cannot be maintained for a long period of time due to wear of the fluorine resin film. Accordingly, development of such a toner is demanded that enables avoidance of coating of a fluorine resin film having low surface energy on a surface of a member in contact with a toner image, such as a fixing roll.

SUMMARY OF THE INVENTION

The invention is developed to solve the problems and to provide a toner for developing electrostatic latent image excellent in releasing property upon fixing and shape controllability upon production of the toner, and a process for producing the toner, and also a process for forming an image, an apparatus for forming an image and a toner cartridge, which use the toner for developing electrostatic latent image.

The invention is to provide:

(i) a toner for developing electrostatic latent image having a number average molecular weight Mn in a range of from 10,000 to 30,000 and a ratio (Mz/Mw) of a Z average molecular weight Mz and a weight average molecular weight Mw in a range of from 3.0 to 6.0, (ii) a process for preparing a toner for developing electrostatic latent image containing steps of:

mixing a resin particle dispersion containing first resin particles dispersed therein, a colorant particle dispersion containing colorant particles dispersed therein, and a releasing agent particle dispersion containing releasing agent particles dispersed therein, each of which has a center particle diameter of 1 $\mu$m or less, to form core aggregated particles containing the first resin particles, the colorant particles and the releasing agent particles (first aggregation step); the first resin particles having a number average molecular weight Mn in a range of from 10,000 to 30,000 and a ratio Mz/Mw) of a Z average molecular weight Mz and a weight average molecular weight Mw in a range of from 3.0 to 6.0, forming a shell layer containing second resin particles on a surface of the core aggregated particles to obtain core/shell aggregated particles (second aggregation step); and heating the core/shell aggregated particles to a temperature equal to or higher than a glass transition temperature of the first resin particles or the second resin particles to coalesce the core/shell aggregated particles (coalescence step), (iii) a process for forming an image containing steps of: charging a surface of a member for holding an image; forming an electrostatic latent image on the charged surface of the member for holding an image corresponding to image information; developing the electrostatic latent image formed on the surface of the member for holding an image with a developer containing at least a toner to obtain a toner image; and fixing the toner image on a surface of a recording medium, the toner having a number average molecular weight Mn in a range of from 10,000 to 30,000 and a ratio (Mz/Mw) of a Z average molecular weight Mz and a weight average molecular weight Mw in a range of from 3.0 to 6.0, (iv) an apparatus for forming an image containing a charging unit for charging a surface of a member for holding an image, an electrostatic latent image forming unit for forming an electrostatic latent image corresponding to image information on the surface of the member for holding an image, a developing unit for developing the electrostatic latent image formed on the surface of the member for holding an image with a developer containing at least a toner to obtain a toner image, and a fixing unit for fixing the toner image on a surface of a recording medium, the toner having a number average molecular weight Mn in a range of from 10,000 to 30,000 and a ratio (Mz/Mw) of a Z average molecular weight Mz and a weight average molecular weight Mw in a range of from 3.0 to 6.0, and (v) a toner cartridge detachably installed in an apparatus for forming an image, the toner cartridge enclosing a toner to be supplied to a developing unit provided in the apparats for forming an image, the toner having a number average molecular weight Mn in a range of from 10,000 to 30,000 and a ratio (Mz/Mw) of a Z average molecular weight Mz and a weight average molecular weight Mw in a range of from 3.0 to 6.0.

BRIEF DESCRIPTION OF THE DRAWING

Prefer embodiments of the invention will be described in detail based on the following FIGURE, wherein.

DESCRIPTION OF THE PREFERRED EMBODIMENTS

Figure 1:
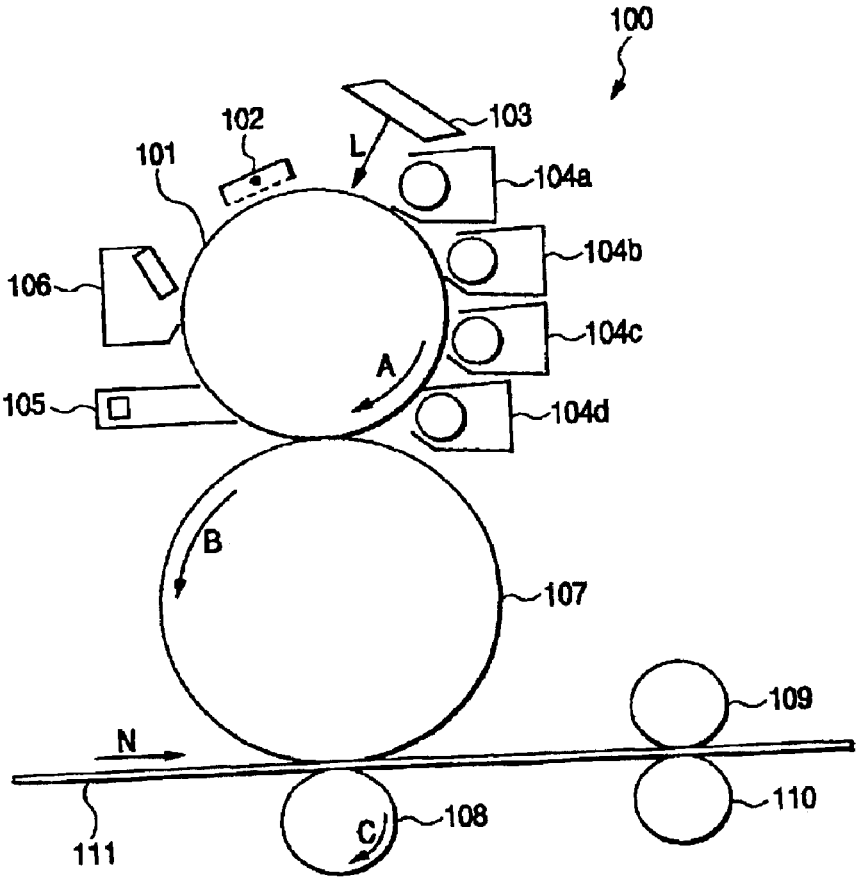
FIG. 1 is a schematic diagram showing an example of an apparatus for forming an image according to the invention.

The invention will be described in the order of the toner for developing electrostatic latent image, the process for producing the same, the process for forming an image, the apparatus for forming an image, and the toner cartridge.

<Toner for Developing Electrostatic Latent Image and Process for Producing the Same>

The toner for developing electrostatic latent image (hereinafter, sometimes abbreviated to a "toner") of the invention has a number average molecule weight Mn in a range of from 10,000 to 30,000 and a ratio (Mz/Mw) of a Z average molecular weight Mz and a weight average molecular weight Mw in a range of from 3.0 to 6.0, Therefore, the toner of the invention is excellent in releasing property upon fixing and shape controllability upon production of the toner. Owing to the improvement in releasing property upon fixing, a resin film having low surface energy, such as a fluorine resin and a silicone resin, is not necessarily provided on a surface of a member in contact with a toner image, such as a fixing roll, in the case where the fixing is cared out by using the toner of the invention. Furthermore, owing to the excellent shape controllability upon production of the toner, such problems can be prevented as scatting of the toner and deterioration in image quality caused by the shape of the toner.

The number average molecular weight Mn of the toner of the invention is necessarily in a range of from 10,000 to 30,000, and preferably in a range of from 11,000 to 25,000. In the case where the number average molecular weight Mn is less than 10,000, not only the fixing property is lowered, but also the toner gets sticky upon heating for fixing to lower the releasing property. In the case where the number average molecular weight Mn exceeds 30,000, the flowability of the toner upon heating to a temperature exceeding the glass transition temperature (Tg) of the toner is lowered, and thus the shape controllability upon production of the toner is impaired. The conventional toner has a number average molecular weight Mn in an order of several thousands.

The Z average molecular weight Mz is such a value that mainly expresses the distribution of a high molecular weight fraction in the molecular weight distribution of the toner and, it is important because the distribution reflects toughness of the molten toner upon releasing. The ratio (Mz/Mw) of the Z average molecular weight Mz and the weight average molecular weight Mw expresses the distribution of the high molecular weight fraction of the toner, and in the invention, it is necessarily in a range of from 3.0 to 6.0, and preferably in a range of from 3.2 to 5.8.

In the case where the ratio Mz/Mw is less than 3.0, the releasing property is lowered. In the case where the ratio Mz/Mw exceeds 6.0, the shape controllability upon production of the toner is deteriorated.

The production process of the toner of the invention is not particularly limited, and in order to adjust the values of Mn and Mz/Mw in the foregoing ranges, the toner is preferably produced by the following production process from the practical standpoint.

The toner of the invention is preferably produced by a process containing a first aggregation step of mixing a resin fine particle dispersion containing first resin fine particles dispersed therein, a colorant particle dispersion containing colorant particles dispersed therein, and a releasing agent particle dispersion containing releasing agent particles dispersed therein, each of which has a center particle diameter of 1 $\mu$m or less, to form core aggregated particles containing the first resin fine particles, the colorant particles and the releasing agent particles; a second aggregation step of forming a shell layer containing second resin fine particles on a surface of the core aggregated particles to obtain core/shell aggregated particles; and a coalescence step of heating the core/shell aggregated particles to a temperature equal to or higher than a glass transition temperature of the first resin fine particles or the second resin fine particles to coalesce the core/shell aggregated particles.

Detail of the production process that is preferred for producing the toner of the invention will be described later.

Upon producing the toner of the invention, the core aggregated particles containing the first resin fine particles, the colorant particles and the releasing agent particles are formed in the first aggregation step, and then the second resin fine particles are again attached to the surface of the core aggregated particles in the second aggregation step, whereby a coating layer (shell layer) containing the second resin fine particles is formed to obtain the aggregated particles having a core/shell structure (core/shell aggregated particles) containing the core aggregated particles having the shell layer provided on the surface thereof. The thickness of the shell layer is not particularly limited and is preferably in a range of from 150 to 300 nm.

In the case where the thickness of the shell layer is less than 150 nm, there are some cases where the releasing agent is eluted to the surface of the toner, and a photoreceptor and the like member are contaminated as a result of the elution of the releasing agent. In the case where the thickness of the shell layer exceeds 300 nm, there are some cases where the viscosity of the slurry in the process step for forming the core component is lowered, and the number of the resin fine particles added for forming the shell is suddenly increased to considerably increase the slurry viscosity in the system, whereby the particle diameter and the particle diameter distribution are deteriorated upon forming the shell. Furthermore, fine particles are liable to be generated upon forming the shell, and such problems upon production of the toner occur that clogging is liable to occur in the case where a toner slurry containing the remaining resin fine particles is subjected to solid-liquid separation or removal by filtration.

The toner of the invention preferably has a volume average particle size distribution index GSDv of 1.30 or less and a ratio (GSDv/GSDp) of a volume average particle size distribution index GSDv and a number average particle size distribution index GSDp of 0.95 or more.

In the case where the volume average particle size distribution index GSDv exceeds 1.30, there are some cases where the resolution of the image is lowered. When the ratio (GSDv/GSDp) of a volume average particle size distribution index GSDv and a number average particle size distribution index GSDp is less than 0.95, there are some cases where lowering of the charging property of the toner, scattering of the toner and fogging are caused to bring about image defects.

In the invention, the values of the particle diameter, the volume average particle size distribution index GSDv and the number average particle size distribution index GSDp of the toner are measured in the following manner. A particle size distribution of the toner measured by measuring equipments, such as Coulter Counter TAII (produced by Nikkaki Co., Ltd.) and a Multisizer II (produced by Nikkaki Co. Ltd.), is divided into particle size ranges (channels), and accumulated distributions of the volume and the number of the respective toner particles are drawn for the channels. The particle diameters providing an accumulation of 16% are designated as a volume average particle diameter D16v and a number average particle diameter D16p, the particle diameters providing an accumulation of 50% are designated as a volume average particle diameter D50v and a number average particle diameter D50p, and the particle diameters providing an accumulation of 84% are designated as a volume average particle diameter D84v and a number average particle diameter D84p. The volume average particle size distribution index GSDv is defined by $(D84v/D16v)^{1/2}$, and the number average particle size distribution index GSDp is defined by $(D84p/D16p)^{1/2}$. The volume average particle size distribution index GSDv and the number average particle size distribution index GSDp can be calculated from the relationships.

The toner of the invention preferably has a surface property index defined by the following equation (1) of 2.0 or less:

$$\text{(Surface property index)}=\text{(Measured specific surface area)}/\text{(Calculated specific surface area)} \quad (1)$$

In the equation (1), the calculated specific surface area is shown by the following equation:

$$6\Sigma(n\times R^2)/(\rho\times\Sigma(n\times R^3))$$

In the equation showing the calculated specific surface area, n represents the number of particles in a channel of a Coulter Counter (number per channel), R represents the channel particle diameter in the Coulter Counter ($\mu$m), and $\rho$ represents the toner density (g/$\mu m^3$). The divided number of the channels is 16. The interval of the division is 0.1 in terms of log scale.

The surface property index is preferably 2 or less, and more preferably 1.8 or less. In the case where it exceeds 2, there are some cases where the smoothness on the surface of the toner is impaired, and an external additive to the surface of the toner is buried thereon to lower the charging property.

The calculated specific surface area is obtained by measuring the particle diameter and the number of particles in the respective channels of a Coulter Counter, and the respective particles are converted as spheres with the particle size distribution regarded.

The measured specific surface area is measured based on the gas adsorption and desorption method and can be obtained with a Langmuir surface area. As a measuring apparatus, for example, Coulter Model SA3100 (produced by Beckman Coulter, Inc.) and Gemini 2360/2375 (produced by Shimadzu Corp.) can be used.

The toner of the invention preferably has a shape factor SF1 defined by the following equation (2) in a range of from 120 to 135:

$$SF1=ML^2/(4A/\pi)\times 100 \quad (2)$$

In the equation (2), ML represents a maximum length of the toner particles ($\mu$m), and A represents a projected area of the toner particles ($\mu m^2$).

In the case where the shape factor SF1 is less than 120, in general, the toner remains in the transferring step upon production of an image to bring about necessity of removal of the remaining toner, and the cleaning property upon cleaning the remaining toner with a blade is liable to be deteriorated. As a result, there are some cases where image defects occur.

In the case where the shape factor SF1 exceeds 135, there are some cases where, upon using the toner as a developer, the toner is damaged through collision with a carrier in a developing device. In this case, not only the amount of fine powder is increased as a result, and the surface of the photoreceptor is contaminated with the releasing agent component exposed on die surface of the toner to impair the charging characteristics, but also the fine powder causes such a problem as formation fogging.

The shape factor SF1 is measured in the following manner by using a Luzex image analyzer (FT, produced by Nireco Corp.).

An optical micrograph of the toner scattered on slide glass is imported to a Luzex image analyzer through a video camera, and the maximum length (ML) and the projected area (A) are measured for 50 or more toner particles. A value of (square of maximum length)/(4((projected area/$\pi$))$\times$100, i.e., $ML^2/(4A/\pi)\times 100$, is calculated for the respective toner particles, and an average value of the resulting values is obtained as the shape factor SF1.

The absolute value of the charging amount of the toner of the invention is preferably in a range of from 20 to 40 $\mu$C/g, and more preferably in a range of from 15 to 35 $\mu$C/g. In the case where the charging amount is less than 20 $\mu$C/g, there are some cases where background staining (fogging) is liable to occur, and in the case where it exceeds 40 $\mu$C/g, there are some cases where the image density is liable to be lowered.

The ratio of the charging amount in summer season (high temperature and high humidity, 28° C., 85% RH) and that in winter season (low temperature and low humidity, 10° C., 30% RH) of the toner of the invention, i.e., (charging amount under high temperature and high humidity)/(charging amount under low temperature and low humidity), is preferably from 0.5 to 1.5, and more preferably from 0.7 to 1.3. In the case where the ratio is outside the range, the environment dependency of the charging property is too high, and there are some cases where it is not preferred for practical use since the stability in charging is deteriorated.

The particle diameter of the toner of the invention is preferably in a range of from 3 to 9 $\mu$m, and more preferably in a range of from 3 to 8 $\mu$m. In the case where the particle diameter is less than 3 $\mu$m, when the charging property of the toner is insufficient to lower the developing property, and when it exceeds 9 $\mu$m, there are some cases where the resolution of the image is lowered.

<Process for Producing Toner>

The process for producing a toner that is preferred for producing the toner of the invention will be described.

The process for producing a toner according to the invention contains a first aggregation step of mixing a resin fine particle dispersion containing first resin fine particles dispersed therein, a colorant particle dispersion containing colorant particles dispersed therein, and a releasing agent particle dispersion containing releasing agent particles dispersed therein, each of which has a center particle diameter of 1 $\mu$m or less, to form core aggregated particles containing the first resin fine particles, the colorant particles and the releasing agent particles; a second aggregation step of forming a shell layer containing second resin fine particles on a surface of the core aggregated particles to obtain core/shell aggregated particles; and a fusing and integration step of heating the core/shell aggregated particles to a temperature equal to or higher than a glass transition temperature of the first resin fine particles or the second resin fine particles to fuse and integrate the core/shell aggregated particles.

In the case where a toner is produced by the process for producing a toner of the invention, the toner of the invention can be conveniently obtained that has a number average molecular weight Mn in a range of from 10,000 to 30,000 and a ratio (Mz/Mw) of a Z average molecular weight Mz and a weight average molecular weight Mw in a age of from 3.0 to 6.0.

In the fit aggregation step, a resin fine particle dispersion, a colorant particle dispersion and a releasing agent particle dispersion are prepared. The resin fine particle dispersion can be prepared in such a manner that fist resin fine particles produced, for example, by emulsion polymerization are dispersed in a solvent by using an ionic surfactant. The colorant particle dispersion is produced in such a manner that colorant particles having a desired color, such as cyan, magenta, yellow, are dispersed in a solvent by using an ionic surfactant having such a polarity that is opposite to that of the ionic surfactant used for producing the resin fine particle dispersion. The releasing agent dispersion is prepared in such a manner that a releasing agent is dispersed in water along with an ionic surfactant or a polymer electrolyte, such as a polymer acid and a polymer base, and it is heated to a temperature higher than the melting point thereof and simultaneously pulverized into fine particles with a homogenizer or a pressure discharge dispersing machine capable of applying a strong shearing force.

The resin fine particle dispersion, the colorant dispersion and the releasing agent dispersion are mixed and the first resin fine particles, the colorant particles and the releasing agent particles are subjected to hereto-aggregation to form aggregated particles (core aggregated particles) containing the first resin fine particles, the colorant particles and the releasing agent particles and having such a diameter that is substantially close to the desired diameter of the toner.

In the second aggregation step, second resin fine particles are attached on the surface of the core aggregated particles obtained in the first aggregation step by using a resin fine particle dispersion containing the second resin fine particles, to form a coating layer (shell layer) having a desired thickness, whereby aggregated particles (core/shell aggregated particles) having a core/shell structure, in which the shell layer is formed, are obtained on the surface of the core aggregated particles. The second resin fine particles used herein may be either the same as or different from the first resin fine particles.

The particle diameters of the first resin fine particles, the second resin fine particles, the colorant particles and the releasing agent particles used in the first and second aggregation steps are preferably 1 $\mu$m or less, and more preferably in a range of from 100 to 300 nm, in order to easily adjust the particle diameter and the particle size distribution of the toner to the desired values.

In the first aggregation step, the balance of the amounts of the two ionic surfactants having different polarities (dispersants) contained in the resin fine particle dispersion and the colorant particle dispersion may be previously deviated. For example, it is possible that an inorganic metallic salt, such as calcium nitrate, or a polymer of an inorganic metallic salt, such as polyaluminum chloride, is used to neutralize them, and the core aggregated particles are produced by heating to a temperature equal to or lower than the glass transition temperature of the first resin fine particles.

In this case, in the second aggregation step, a resin fine particle dispersion having been treated with a dispersant having such a polarity and an amount that compensate the deviation in balance of the two dispersants having different polarities is added to a solution containing the core aggregated particles, and depending on necessity, the mixture is slightly heated to a temperature equal to or lower than the glass transition temperature of the core aggregated particles or the second resin fine particles used in the second aggregation step, whereby the core/shell aggregated particles can be produced.

The first and second aggregation steps each may be repeatedly and stepwise carried out by dividing into plural steps.

In the coalescence step, the core/shell aggregated particles obtained though the second aggregation step are heated in the solution to a temperature equal to or higher than the glass transition temperature of the first or second resin fine particles contained in the core/shell aggregated particles (in the case where two or more kinds of resins are used, the glass transition temperature of the resin having the highest glass transition temperature) to obtain a toner through coalescence.

After completing the coalescence step, the toner formed in the solution is subjected to known process steps including a washing step, a solid-liquid separation step and a drying step, to obtain the toner in a dry state.

The washing step is preferably carried out by sufficient substitution washing with ion exchanged water from the standpoint of charging property. The solid-liquid separation step is preferably carried out by using suction filtration or pressure filtration from the standpoint of productivity while not particularly limited. The drying step is also not particularly limited, and is preferably carried out, for example, by freeze dying, flash-jet drying, fluidized drying and vibration fluidized drying, from the standpoint of productivity.

In the toner thus obtained, the releasing agent is preferably contained in an amount in a range of from 5 to 25% by weight. The releasing agent is contained in the core aggregated particles covered with the shell layer as described in the foregoing, and thus the releasing agent can be prevented from flowing out to the surface of the toner to assure the charging property and the durability.

<Constitutional Materials of Toner>

The resin used in the toner of the invention is not particularly limited, and known resin material can be used. Examples thereof include a polymer of a monomer, such as a styrene compound, e.g., styrene, p-chlorostyrene and $\alpha$-methylstyrene, an ester having a vinyl group, e.g., methyl acrylate, ethyl acrylate, n-propyl acrylate, n-butyl arrylate, lauryl acrylate, 2-ethylhexyl acrylate, metyl methacrylate, ethyl methacrylate, n-propyl methacrylate, lauryl methacrylate and 2-ethylhexyl methacrylate, a vinylnitrile compound, e.g., acrylonitrile and methacrylonitril, a vinyl ether compound, e.g., vinyl methyl ether and vinyl isobutyl ether, a vinyl ketone compound, such as vinyl methyl ketone, vinyl ethyl ketone and vinyl isopropenyl ketone, and a polyolefin compound, such as ethylene, propylene and butadiene, a copolymer obtained by combining two or more kinds of these monomers, and a mixture thereof. Examples thereof further include a non-vinyl condensation resin, such as an epoxy resin, a polyester resin, a polyurethane resin, a polyamide resin, a cellulose resin and a polyether resin, a mixture of them with the vinyl resin, and a graft polymer obtained by polymerizing the vinyl monomer in the presence of these resins.

In the case where the resin is produced by using a vinyl monomer, a resin fine particle dispersion can be produced by carrying out emulsion polymerization by using an ionic surfactant. In the case of other resins that are oleophilic and dissolved in a solvent having a relatively low solubility in water, the resin is dissolved in the solvent, and the solution is finely dispersed in water along with an ionic surfactant or a polymer electrolyte with a dispersing machine, such as a homogenizer, followed by evaporating the solvent through heating or reduction in pressure, to produce the resin fine particle dispersion.

The particle diameter of the resin fine particle dispersion thus obtained can be measured, for example, with a laser diffraction particle size distribution measuring device (LA-700, produced by Horiba, Ltd.).

The releasing agent used in the toner of the invention is preferably such a substance that has a primary maximum peak in a range of from 50 to 140° C. maeasured according to ASTM D3418-8. In the case where the primary maximum peak is lower than 50° C., there are some cases where offset is liable to occur upon fixing. In the case where it exceeds 140° C., there are some cases where the fixing temperature is too high, and the smoothness on the surface of the image is insufficient to impair glossiness.

The measurement of the primary maximum peak can be carried out by using, for example, DSC-7, produced by Perkin-Elmer, Inc. In this equipment, the temperature correction of the detecting element is effected by using the melting point of indium and zinc, and the correction of heat quantity is effected by using the melting heat of indium. A sample is placed on an aluminum pan with a blank pan used for control, and the measurement is carried out at a temperature increasing rate of 10° C. per minute.

The viscosity $\eta 1$ at 160° C. of the releasing agent is preferably in a range of from 2 to 600 cps. When the viscosity $\eta 1$ is less than 2 cps, thee are some cases where hot offset is liable to occur, and when it exceeds 600 cps, there are some cases where cold offset upon fixing occurs.

The ratio ($\eta 2/\eta 1$) of the viscosity at 200° C. $\eta 2$ and the viscosity at 160° C. $\eta 1$ of the releasing agent is preferably in a range of from 0.5 to 0.7. When the ratio $\eta 2/\eta 1$ is less than 0.5, there are some cases where the bleeding amount at a low temperature is too small to cause cold offset. When it exceeds 0.7, there are some cases where the bleeding amount upon fixing at a high temperature is too large to cause not only wax offset but also a problem in stability upon releasing.

Specific examples of the releasing agent include a low molecular weight polyolefin, such as polyethylene, polypropylene and polybutene, a silicone compound having a softening point upon heating, an aliphatic amide compound, such as oleic amide, erucic amide, recinoleic amide and stearic amide, vegetable wax, such as carnauba wax, rice wax, candelilla wax, wood wax and jojoba oil, animal wax, such as yellow beeswax, mineral or petroleum wax, such as montan wax, ozokerite, ceresin, paraffin wax, microcrystalline wax and Fischer-Tropsch wax, and a modification product thereof.

The releasing agent dispersion containing releasing agent particles having a particle diameter of 1 $\mu$m or less can be produced in such a manner that the releasing agent is dispersed in water along with an ionic surfactant or a polymer electrolyte, such as a polymer acid and a polymer base, and is dispersed into fine particles by heating to a temperature higher than the melting point thereof and simultaneously applying with a strong shearing force in a homogenizer or a pressure discharge dispersing machine.

The particle diameter of the releasing agent particle dispersion thus obtained can be measured, for example, with a laser diffraction particle size distribution measuring device (LA-700, produced by Horiba, Ltd.).

Known colorants can be used as the colorant used in the invention.

Examples of a yellow pigment include Hansa Yellow, Hansa Yellow 10G, Benzidine Yellow G. Benzidine Yellow GR, Threne Yellow, Quinoline Yellow and Permanent Yellow NCG.

Examples of a red pigment include red iron oxide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosin Red and Alizarin Lake.

Examples of a blue pigment include Prussian Blue, Cobalt Blue, Alkaline Blue Lake, Victoria Blue Lake, Past Sky Blue, Indanthrene Blue BC, Anilne Blue, Ultramarine Blue, Calco Oil Blue, Methylene Blue Chloride, Phthalocyanine Blue, Phthalocyanine Green and Malachite Green Oxalate. These may be used after mixing and can also be used in the form of a solid solution.

The colorant can be dispersed by the known method, and for example, a rotation shearing homogenizer, a media dispersing machine, such as a ball mill, a sand mill and an attritor, and a high pressure counter collision dispersing machine are preferably used.

The colorant particle dispersion can be produced in such a manner that the colorant is dispersed in an aqueous solvent by using an ionic surfactant having a polarity with the homogenizer having been described.

The colorant is selected under consideration of hue angle, chroma saturation, brightness, weather resistance, OHP transparency and dispersibility in the toner. The addition amount of the colorant in the toner of the invention is preferably in a range of from 4 to 20 parts by weight per 100 parts by weight of the resin contained in the toner.

A charge controlling agent may be added to the toner of the invention for improving and stabilizing the charging property. Examples of the charge controlling agent include various kinds of charge controlling agents that are generally used, such as a quaternary ammonium salt compound, a nigrosine compound, a dye a complex of aluminum, iron or chromium, and a triphenylmethane pigment. Materials that are difficult to be dissolved in water am preferred from the standpoint of control of the ion strength influencing the stability of the aggregated particles in the first and second aggregation steps and the coalescence step, and reduction of pollution due to waste water.

In the case where inorganic fine particles as the charge controlling agent are added to the toner by a wet method, examples of the inorganic fine particles include any inorganic fine particles that are generally used as an external additive to the surface of the toner, such as silica, alumina, titania, calcium carbonate, magnesium carbonate and tricalcium phosphate. In this case, the inorganic fine particles can be used by dispersing in a solvent by using an ionic surfactant, a polymer acid or a polymer base.

As similar to the ordinary toners, in order to impart flowability and to improve the cleaning property, inorganic particles, such as silica, alumina, titania and calcium carbonate, and resin particles, such as a vinyl resin, polyester and silicone, may be added as a flowability assistant or a cleaning assistant to the surface of the toner of the invention by applying a shearing force under a dry state.

On producing the toner of the invention, Examples of the surfactant used in emulsion polymerization, dispersion of the pigment, dispersion of the resin fine particles, dispersion of the releasing agent, aggregation, and stabilization thereof include an anionic surfactant, such as a sulfate ester compound, a sulfonate ester compound, a phosphoric acid ester compound and a soap compound, a cationic surfactant, such as an amine salt compound and a quaternary ammonium salt compound, and a nonionic surfactant, such as a polyethylene glycol compound, an alkylphenol ethylene oxide adduct and a polyhydric alcohol compound, which are effectively used in combination. Examples of the dispersing machine used therein include ordinary ones, such as a rotation shearing homogenizer, a media dispersing machine, such as a ball mill, a sand mill and a dynomill.

<Process for Forming Image and Apparatus for Forming Image>

The process for forming an image and the apparatus for forming an image using the toner of the invention will be described.

The process for forming an image according to the invention contains a charging step of charging a surface of a member for holding an image; an electrostatic latent image forming step of forming an electrostatic latent image on the charged surface of the member for holding an image corresponding to image information; a developing step of developing the electrostatic latent image formed on the surface of the member for holding an image with a developer containing a toner to obtain a toner image; and a fixing step of fixing the toner image on a surface of a recording medium, in which the toner used herein is the toner of the invention.

Therefore, because the process for forming an image according to the invention uses the toner of the invention excellent in releasing property upon fixing and in shape controlling property upon production of the toner, the process is excellent in releasing property of the member in contact with the toner image upon fixing and can prevent occurrence of problems, such as scattering of the toner upon development and deterioration of image quality of the image after fixing.

The process for forming an image according to the invention is not particularly limited as far as it contains the charging step, the electrostatic latent image forming step, the developing step and the fixing step, and may contain other steps, for example, a transferring step of transferring the toner image formed on the surface of the member for holding an image after the developing step to a transfer material.

The apparatus for forming an image according to the invention contains a charging unit for charging a surface of a member for holding an image, an electrostatic latent image forming unit for forming an electrostatic latent image corresponding to image information on the charged surface of the member for holding an image, a developing unit for developing the electrostatic latent image formed on the surface of the member for holding an image with a developer containing at least a toner to obtain a toner image, and a fixing unit for fixing the toner image on a surface of a recording medium, in which the toner used herein is the toner of the invention.

Therefore because the apparatus for forming an image according to the invention uses the toner of the invention excellent in releasing property upon fixing and in shape controlling property upon production of the toner, the apparatus is excellent in releasing property of the member in contact with the toner image upon fixing and can prevent occurrence of problems, such as scattering of the toner upon development and deterioration of image quality of the image after fixing.

The apparatus for forming an image according to the invention is not particularly limited as far as it contains the charging unit, the electrostatic latent image forming unit, the developing unit and the fixing unit, and may contain other units, for example, a transferring unit of transferring the toner image formed on the surface of the member for holding an image after the developing step to a transfer material.

The process for forming an image according to the invention using the apparatus for forming an image according to the invention will be specifically described below. The invention is not construed as being limited to the specific examples described below.

FIG. 1 is a schematic diagram showing an example of the apparatus for forming an image according to the invention. In FIG. 1, an apparatus for forming an image 100 contains a member for holding an image 101, a charging unit 102, a writing unit 103 for forming an electrostatic latent image, developing units 104*a*, 104*b*, 104*c* and 104*d* enclosing developers of colors, black (K), yellow (Y), magenta (M) and cyan (C), respectively, a destaticizing lamp 105, a cleaning unit 106, an intermediate transfer material 107, and a transferring roll 108. The developers enclosed in the developing units 104*a*, 104*b*, 104*c* and 104*d* each contain the toner of the invention.

In the surrounding of the member for holding an image 101, the following members are arranged in the following order along the rotation direction of the member for holding an image 101 (expressed by the arrow A), i.e., the non-contact type charging unit 102 for uniformly charging the surface of the member for holding an image 101; the writing unit 103 for forming an electrostatic latent image on the surface of the member for holding an image 101 by irradiating the surface of the member for holding an image 101 by scanning exposure expressed by the arrow L corresponding to image information; the developing units 104*a*, 104*b*, 104*c* and 104*d* supplying the toners of the respective colors to the electrostatic latent image; the intermediate transfer material 107 having a drum form in contact with the surface of the member for holding an image 101 and being capable of dependently rotating in the direction expressed by the arrow B associated with the rotation of the member for holding an image 101 in the direction expressed by the arrow A; the destaticizing lamp 105 for destaticizing the surface of the member for holding an image 101; and the cleaning unit 106 in contact with the surface of the member for holding an image 101.

On the side of the intermediate transfer material 107 opposite to the member for holding an image 101, a transferring roll 108 capable of being controlled to be contact or not to be contact with the surface of the intermediate transfer material 107 is provided, and the transferring roll 108 upon contacting therewith is capable of dependently rotating in the direction expressed by the arrow C associated with the rotation of the intermediate transfer material 107 in the direction expressed by the arrow B.

A recording material 111 can be conveyed in the direction expressed by the arrow N by a conveying unit, which is not shown in the FIGURE, from the side opposite to the arrow N and can be inserted and passed between the intermediate transfer material 107 and the transferring roll 108. A fixing roll 109 containing a heat source, which is not shown in the FIGURE, is provided ahead the intermediate transfer material 107 in the direction expressed by the arrow N. A pressure roll 110 is provided ahead the transferring roll 108 in the direction expressed by the arrow N. The fixing roll 109 and the pressure roll 110 are in contact with each other to form a pressure contact part (nip part). The recording medium 111 passed between the intermediate transfer material 107 and the transferring roll 108 can be inserted and passed through the pressure contact part in the direction expressed by the arrow N.

Because the apparatus for forming an image of the invention uses the toner of the invention excellent in releasing property upon fixing, it is not necessary that the surface of the fixing roll 109 is covered with a conventional film having low surface energy, such as a fluorine resin film. In this case, the surface of the fixing roll 109 may be a core metallic material of the fixing roll 109, such as a SUS material and an A1 material, exposed thereon as it is.

The image formation by using the apparatus for forming an image 100 will be described. The surface of the member for holding an image 101 is charged with the non-contact charging unit 102 associated with rotation of the member for holding an image 101 in the direction expressed by the arrow A, and an electrostatic latent image corresponding to image information of one of the respective colors is formed with the writing unit 103 on the surface of the member for holding an image 101 thus charged. The toner is supplied from the developing unit 104*a*, 104*b*, 104*c* or 104*d* to the surface of the member for holding an image 101 having the electrostatic latent image formed thereon according to the color information of the electrostatic latent image, so as to form a toner image.

The toner image formed on the surface of the member for holding an image 101 is transferred to the surface of the intermediate transfer material 107 at the contact part of the member for holding an image 101 and the intermediate transfer material 107 through application of a voltage between the member for holding an image 101 and the intermediate transfer material 107 from a power source, which is not shown in the FIGURE.

The surface of the member for holding an image 101 having a toner image transferred to the intermediate transfer material 107 is destaticized by irradiation of light from the destaticizing lamp 105, and the toner remaining on the surface is removed by a cleaning blade of the cleaning unit 106.

The foregoing process steps are repeated for the respective colors, whereby the toner images of the respective colors are formed as accumulated according to the image information on the surface of the intermediate transfer material 107.

The transferring roll 108 is not in contact with the intermediate transfer material 107 during the foregoing process steps, and it is then made in contact with the intermediate transfer material 107 upon transferring to the recording medium 111 after completion of accumulation and formation of the toner images of all the colors on the surface of the intermediate transfer material 107.

The toner images thus accumulated and formed on the surface of the intermediate transfer material 107 are moved to the contact part of the intermediate transfer material 107 and the transferring roll 108 associated with the rotation of the intermediate transfer material 107 in the direction shown by the arrow B. At this time, the recording medium 111 is conveyed and inserted in the direction shown by the arrow N with a paper conveying roll, which is not shown in the FIGURE, and the toner images accumulated and formed on the surface of the intermediate transfer material 107 are transferred at once to the surface of the recording medium 111 at the contact part with a voltage applied between the intermediate transfer material 107 and the transferring roll 108.

The recording medium 111 having the toner images having been transferred on the surface thereof is conveyed to the nip part of the fixing roll 109 and the pressure roll 110, and is heated upon passing the nip part with the fixing roll 109 having a surface heated with the heat source, which is not shown in the FIGURE, incorporated therein. At this time, an image is formed through fixing the toner images on the surface of the recording medium 111.

<Toner Cartridge>

The toner cartridge according to the invention will be described. The toner cartridge according to the invention is detachably installed in an apparatus for forming an image, and encloses a toner to be supplied to a developing unit provided in the apparatus for forming an image, in which the toner used herein is the toner of the invention.

Therefore, because in the apparatus for forming an image having the toner cartridges according to the invention detachably installed therein uses the toner cartridge enclosing the toner of the invention, image formation can be carried out by using the toner of the invention excellent in releasing property upon fixing and in shape controlling property upon production of the toner, excellent releasing property to a member in contact with the toner image upon fixing can be obtained, and such problems as scattering of the toner upon development and deterioration of image quality of the image after fixing can be prevented from occurring.

In the case where the apparatus for forming an image shown in FIG. 1 is an apparatus for forming an image having toner cartridges detachably installed therein, for example, the developing units 104*a*, 104*b*, 104*c* and 104*d* are connected to toner cartridges, which are not shown in the FIGURE, with toner supplying tubes, which are not shown in the FIGURE, respectively, corresponding to the respective developing units (colors).

In this case, upon forming an image, the toners are supplied to the developing units 104*a*, 104*b*, 104*c* and 104*d* from the toner cartridges with toner supplying tubes, respectively corresponding to the respective developing units (colors), and therefore, an image can be formed over a long period of time by using the toners according to the invention.

In the case where the amount of the toner enclosed in the toner cartridge is decreased, the toner cartridge can be exchanged.

EXAMPLES

The invention will be described in more detail with reference to the following examples. However, the invention is not construed as being limited to the following examples.

In the examples described below, the toner of the invention is produced by the process for producing a toner according to the invention having been described. The toners obtained in the examples and the comparative examples are evaluated for various properties of the toners, and also images are formed by using an apparatus for forming an image to evaluate for releasing property, fixing property, and scattering and fogging of the toner.

| (Preparation of Resin Fine Particle Dispersion 1) | |
|---|---|
| Styrene (produced by Wako Pure Chemical Industries, Ltd.) | 325 parts by weight |
| n-Butyl acrylate (produced by Wako Pure Chemical Industries, Ltd.) | 75 parts by weight |
| β-Carboxyethyl acrylate (produced by Rhodia Nicca, Ltd.) | 9 parts by weight |
| 1,10-Decanethiol diacrylate (produced by Shin-Nakamura Chemical Corp.) | 1.5 parts by weight |
| Dodecanethiol (produced by Wako Pure Chemical Industries, Ltd.) | 2.7 parts by weight |

The foregoing components are mixed and dissolved, to which a solution obtained by dissolving 4 parts by weight of an anionic surfactant, Dowfax produced by Dow Chemical Inc.), in 550 parts by weight of ion exchanged water is added, followed by subjecting to dispersion and emulsification in a flask. Under slowly stirring and mixing for 10 minutes, 50 parts by weight of ion exchanged water having 6 parts by weight of ammonium persulfate dissolved therein is added thereto. After sufficiently substituting the interior of the flask with nitrogen, the solution in the flask is heated to 70° C. over an oil bath under stirring, and emulsion polymerization is continued for 5 hours, so as to obtain an anionic resin fine particle dispersion 1 having a solid content of 42%.

The resin fine particles of the resin fine particle dispersion 1 have a center diameter of 196nm, a glass transition temperature of 51.5° C. and a weight average molecular weight Mw of 32,400.

| (Preparation of Resin Fine Particle Dispersion 2) | |
|---|---|
| Styrene (produced by Wako Pure Chemical Industries, Ltd.) | 280 parts by weight |
| n-Butyl acrylate (produced by Wako Pure Chemical Industries, Ltd.) | 120 parts by weight |
| β-Carboxyethyl acrylate (produced by Rhodia Nicca, Ltd.) | 9 parts by weight |

The foregoing components are mixed and dissolved, to which a solution obtained by dissolving 1.5 parts by weight of an anionic surfactant, Dowfax (produced by Dow Chemical Inc.), in 550 parts by weight of ion exchanged water is added, followed by subjecting to dispersion and emulsification in a flask Under slowly stirring and mixing for 10 minutes, 50 parts by weight of ion exchanged water having 0.4 part by weight of ammonium persulfate dissolved therein is added thereto. After sufficiently substituting the interior of the flask with nitrogen, the solution in the flask is heated to 70° C. over an oil bath under stirring, and emulsion polymerization is continued for 5 hours, so as to obtain an anionic resin fine particle dispersion 2 having a solid content of 42%.

The resin fine particles of the resin fine particle dispersion 2 have a center diameter of 150 nm, a glass transition temperature of 53.2° C., a weight average molecular weight Mw of 691,200 and a number average molecular weight Mn of 244,900.

| (Preparation of Colorant Particle Dispersion 1) | |
|---|---|
| Carbon black (Regal 330, produced by Cabot Oil & Gas Corp.) | 30 parts by weight |
| Anionic surfactant (Newlex R, produced by NOF Corp.) | 2 parts by weight |
| Ion exchanged water | 220 parts by weight |

The foregoing components are mixed and preliminarily dispersed in a homogenizer (Ultra Turrax, produced by IKA Works Inc.) for 10 minutes, and then subjected to a dispersion treatment by using a counter collision wet pulverizer (Altimizer, produced by Sugino Machinery Industries, Ltd.) at a pressure of 245 MPa for 15 minutes, so as to obtain a colorant particle dispersion 1 containing colorant particles having a center diameter of 354 nm.

| (Preparation of Colorant Particle Dispersion 2) | |
|---|---|
| Blue pigment (Copper Phthalocyanine C.I.PigmentBlue15:3, produced by Dainichiseika Colour & Chemicals Mfg. Co., Ltd.) | 45 parts by weight |
| Ionic surfactant (Neogen RK, produced by Daiichi Kogyo Seiyaku Co., Ltd.) | 5 parts by weight |
| Ion exchanged water | 200 parts by weight |

The foregoing components are mixed and preliminarily dispersed in a homogenizer (Ultra Turrax, produced by IKA Works Inc.) for 10 minutes, and then subjected to a dispersion treatment by using a counter collision wet pulverizer (Altimizer, produced by Sugino Machinery Industries, Ltd.) at a pressure of 245 MPa for 15 minutes, so as to obtain a colorant particle dispersion 2 containing colorant particles having a center diameter of 462 nm.

| (Preparation of Releasing Agent Dispersion 1) | |
|---|---|
| Polyethylene wax (melting point: 103° C., η1 at 160° C.:4.8 mPa/s, η2/η1:0.5) (PW725, produced by Toyo Petrolight Co., Ltd.) | 45 parts by weight |
| Cationic surfactant (Neogen RK, produced by Daiichi Kogyo Seiyaku Co., Ltd.) | 5 parts by weight |
| Ion exchanged water | 200 parts by weight |

The foregoing components are mixed and heated to 95° C., and after sufficiently dispersed with Ultra Turrax T50, produced by IKA Works Inc., the mixture is subjected to a dispersion treatment with a pressure discharge Gorin homogenizer, to obtain a releasing agent particle dispersion 1 containing releasing agent particles having a center diameter of 186 an and a solid content of 21.5%.

| (Preparation of Releasing Agent Dispersion 2) | |
|---|---|
| Polyethylene wax (melting point: 113° C., η1 at 160° C.:36.5 mPa/s, η2/η1:0.67) (PW 1000, produced by Toyo Petrolight Co., Ltd.) | 45 parts by weight |
| Cationic surfactant (Neogen RK, produced by Daiichi Kogyo Seiyaku Co., Ltd.) | 5 parts by weight |
| Ion exchanged water | 200 parts by weight |

The foregoing components are mixed and heated to 100° C., and after sufficiently dispersed with Ultra Turrax T50, produced by IKA Works Inc., the mixture is subjected to a dispersion treatment with a pressure discharge Gorin homogenizer, to obtain a releasing agent particle dispersion 2 containing releasing agent particles having a center diameter of 196 nm and a solid content of 21.5%.

Example 1

| | |
|---|---|
| Resin fine particle dispersion 1 | 64 parts by weight |
| Resin fine particle dispersion 2 | 16 parts by weight |
| Colorant particle dispersion 1 | 45 parts by weight |
| Releasing agent particle dispersion 1 | 36 parts by weight |

The foregoing components are mixed and dispersed in a round-bottom stainless steel flask with Ultra Turrax T50 to obtain a solution.

0.4 part by weight of polyaluminum chloride is Sad to the solution to produce core aggregated particles, and the dispersion operation is continued by using Ultra Turrax. The solution in the flask is heated to 49° C. over an oil bath-for heating under stirring, and after maintaining at 49° C. for 60 minutes, 32 parts by weight of the resin fine particle dispersion 1 is gently added thereto to produce core/shell aggregated particles.

Thereafter, the pH of the solution is adjusted to 5.6 by adding a 0.5 mol/L sodium hydroxide aqueous solution, and the stainless steel flask is sealed. Under continuous stirring by using a magnetic seal, the solution is heated to 96° C., and after maintaining for 5 hours, the solution is cooled to obtain a black toner having a colorant concentration of 26.4% and a surface property index of 1.68.

The black toner dispersed in the solution is filtered and sufficiency washed with ion exchanged water, and the toner is subjected to solid-liquid separation by Nutsche suction filtration. The toner is further again dispersed in 3 L of ion exchanged water at 40° C., followed by stirring and washing at 300 rpm for 15 minutes.

The operation is repeated five times, and at the time when the filtrate has a pH of 7.01, an electroconductivity of 9.8 μS/cm and a surface tension of 71.1 Nm, solid-liquid separation is carried out by Nutsche suction filtration using No. 5A filter paper, and the resulting solid matter of the black toner is subjected to vacuum drying for 12 hours to obtain a toner of Example 1.

(Evaluation of Properties of Toner)

The particle diameter of the toner of Example 1 is measured with a Coulter Counter. The volume average particle diameter D50v is 6.4 μm, the number average particle size distribution index GSDp is 1.20, the volume average particle size distribution index GSDv is 1.18, and the ratio GSDv/GSDp is 0.98.

The shape factor SF1 of the toner particles of Example 1 obtained by shape observation with a Luzex image analyzer is 122. The toner of Example 1 has a number average molecular weight Mn of 12,100 and the ratio Mz/Mw of 3.4. The thickness of the shell layer measured from a transmission electron micrograph is 293 nm.

3.5 g of the toner is mixed with 50 g of a ferrite carrier having an average particle diameter of 50 μm, and the mixture is shaken in a nimbler for 30 hours. Thereafter, the toner is measured for D50v, GSDp and SF1, and it is confirmed that these values are not changed and are the same as those before shaking.

(Addition of External Additive and Preparation of Developer)

3.5 parts by weight of hydrophobic silica (TS720, produced by Cabot Oil & Gas Corp.) is added as an external additive to 50 parts by weight of the toner of Example 1 and blended in a sample mill.

The toner of Example 1 having the external additive added thereto is mixed with a ferrite carrier containing ferrite particles having an average particle diameter of 50 μm having polymethyl methacrylate (produced by Soken Chemical Co., Ltd.) coated on the surface thereof (mixing ratio of polymethyl methacrylate based on ferrite particles: 1% by weight) to make a toner concentration of 5% by weight, and the mixture is stirred and mixed in a ball mill for 5 minutes to prepare a developer.

(Test for Image Formation)

An image is formed by using the developer with an apparatus for forming an image (modified machine of Vivace 555) under controlling the toner carrying amount at 4.5 g/m$^2$, and the image is then fixed at a process speed of 220 nm/sec PAL4 (produced by Fuji Xerox Co., Ltd.) is used as paper for image formation. A fixing roll used in the apparatus for forming an image is made of SUS and has a diameter of 35 mm, in which no coating treatment is made.

As a result, the image thus obtained is sufficiently fixed, and the surface of the paper having the image formed thereon and t he surface of the fixing roll are smoothly released from each other upon fixing. Fogging and scattering of the toner are not observed. The results are shown in Table 1.

Example 2

A toner is produced in the same manner as in Example 1 except that the using amounts of the resin fine particle dispersions 1 and 2 used for producing the core aggregated particles in Example 1 are changed to 56 parts by weight and 24 parts by weight, respectively, the releasing agent particle dispersion 2 is used instead of the releasing agent particle dispersion 1, and the addition amount of the resin fine particle dispersion 1 added upon producing the core/shell aggregated particles is changed to 32 parts by weight, so as to obtain a toner of Example 2 having a surface property index of 1.75.

The particle diameter of the toner of Example 2 is measured with a Coulter Counter. The volume average particle diameter D50v is 6.4 μm the number average particle size distribution index GSDp is 1.24, the volume average particle size distribution index GSDv is 1.18, and the ratio GSDv/GSDp is 0.95.

The shape factor SF1 of the toner of Example 2 obtained by shape observation with a Luzex image analyzer is 135. The toner of Example 2 has a number average molecular weight Mn of 29,400 and the ratio Mz/Mw of 5.9. The thickness of the shell layer measured from a transmission electron micrograph is 210 nm.

3.5 g of the toner is mixed with 50 g of a ferrite carrier having an average particle diameter of 50 μm, and the mixture is shaken in a tumbler for 30 hours. Thereafter, the toner is measured for D50v, GSDp and SF1, and it is confirmed that these values are not changed and are the same as those before shaking.

The external additive is added to the toner of Example 2 in the same manner as in Example 1 to produce a developer, and the test for image formation is carried out by using the developer in the same manner as in Example 1. As a result, the image thus obtained is sufficiently fixed, and the surface of the paper having the image formed thereon and the surface of the fixing roll are smoothly released from each other upon fixing. Fogging and scaring of the toner are not observed. The results are shown in Table 1.

Example 3

A toner is produced in the same manner as in Example 1 except that the using amounts of the resin fine particle dispersions 1 and 2 used for producing the core aggregated particles in Example 1 are changed to 72 parts by weight and 8 parts by weight, respectively, so as to obtain a toner of Example 3 having a surface property index of 1.81.

The particle diameter of the toner of Example 3 is measured with a Coulter Counter. The volume average particle diameter D50v is 6.6 μm the number average particle size distribution index GSDp is 1.25, the volume average particle size distribution index GSDv is 1.21, and the ratio GSDv/GSDp is 0.97.

The shape factor SF1 of the toner particles of Example 3 obtained by shape observation with a Luzex image analyzer is 125. The toner of Example 3 has a number average molecular weight Mn of 11,200 and the ratio Mz/Mw of 3.1. The thickness of the shell layer lured from a transmission electron micrograph is 289 nm.

3.5 g of the toner is mixed with 50 g of a ferrite carrier having an average particle diameter of 50 μm and the mixture is shaken in a tumbler for 30 hours. Thereafter, the toner is measured for D50v, GSDp and SF1, and it is confirmed that these values are not changed and are the same as those before shaking.

The external additive is added to the toner of Example 3 in the same manner as in Example 1 to produce a developer, and the test for image formation is carried out by using the developer in the same manner as in Example 1. As a result, the image thus obtained is sufficiently fixed, and the surface of the paper having the image formed thereon and the surface of the fixing roll are smoothly released from each other upon fixing. Fogging and scattering of the toner are not observed. The results are shown in Table 1.

Example 4

A toner is produced in the same manner as in Example 1 except that the using amounts of the resin fine particle dispersions 1 and 2 used for producing the core aggregated particles in Example 1 are changed to 78 parts by weight and 18 parts by weight, respectively, and the releasing agent particle dispersion 2 is used instead of the releasing agent particle dispersion 1, so as to obtain a toner of Example 4 having a surface property index of 1.34.

The particle diameter of the toner of Example 4 is measured with a Coulter Counter. The volume average particle diameter D50v is 5.8 μm, the number average particle size distribution index GSDp is 1.22, the volume average particle size distribution index GSDv is 1.23, and the ratio GSDv/GSDp is 0.92.

The shape factor SF1 of the toner particles of Example 4 obtained by shape observation with a Luzex image analyzer is 132. The toner of Example 4 has a number average molecular weight Mn of 10,400 and the ratio Mz/Mw of 3.0. The thickness of the shell layer measured from a transmission electron micrograph is 282 nm.

3.5 g of the toner is mixed with 50 g of a ferrite carrier having an average particle diameter of 50 μm and the mixture is shaken in a tumbler for 30 hours. Thereafter, the toner is measured for D50v, GSDp and SF1, and it is confirmed that these values are not changed and are the same as those before shaking.

The external additive is added to the toner of Example 4 in the same manner as in Example 1 to produce a developer, and the test for image formation is carried out by using the developer in the same manner as in Example 1. As a result, the image thus obtained is sufficiently fixed, and the surface of the paper having the image formed thereon and the surface of the fixing roll are smoothly released from each other upon fixing. Fogging and scattering of the toner are not observed. The results are shown in Table 1.

Comparative Example 1

A toner is produced in the same manner as in Example 1 except that the using amounts of the resin fine particle dispersions 1 and 2 used for producing the core aggregated particles in Example 1 are changed to 40 parts by weight and 40 parts by weight, respectively, 54 parts by weight of the releasing agent particle dispersion 2 is used instead of the releasing agent particle dispersion 1, and the amount of the resin fine particle dispersion added for forming the shell is changed to 65 parts by weight, so as to obtain a toner of Comparative Example 1 having a surface property index of 2.02.

The particle diameter of the toner of Comparative Example 1 is measured with a Coulter Counter. The volume average particle diameter DS50v is 6.7 μm, the number average particle size distribution index GSDp is 1.25, the volume average particle size distribution index GSDv is 1.31, and the ratio GSDv/GSDp is 0.94.

The shape factor SF1 of the toner particles of Comparative Example 1 obtained by shape observation with a Luzex image analyzer is 145. The toner of Comparative Example 1 has a number average molecular weight Mn of 31,300 and the ratio Mz/Mw of 6.2. The thickness of the shell layer measured from a transmission electron micrographic is 525 mn.

3.5 g of the toner is mixed with 50 g of a ferrite carrier having an average particle diameter of 50 μm, and the mixture is shaken in a tumbler for 30 hours. Thereafter, the toner is measured for DS50v, GSDp and SF1, and it is found that D50v is lowered to 6.1 μm, and GSDp becomes 1.37. Furthermore, SF1 is lowered to 137, and thus it is found that the toner is broken.

The external additive is added to the toner of Comparative Example 1 in the same manner as in Example 1 to produce a developer, and the test for image formation is carried out by using the developer in the same manner as in Example 1. As a result, although the releasing property between the surface of the paper having the image formed thereon and the surface of the fixing roll upon fixing is sufficient, the image is easily damaged by weakly rubbing with nail, and thus the fixing property is insufficient. Fogging is found in the image. The results are shown in Table 1.

Comparative Example 2

A toner is produced in the same manner as in Example 1 except that the using amounts of the resin fine particle dispersions 1 and 2 used for producing the core aggregated particles in Example 1 are changed to 75 parts by weight and 5 parts by weight, respectively, the releasing agent particle dispersion 2 is used instead of the releasing agent particle dispersion 1, and the amount of the resin fine particle dispersion added after producing the core aggregated particles is changed to 72 parts by weight, so as to obtain a toner of Comparative Example 2 having a surface property index of 2.03.

The particle diameter of the toner of Comparative Example 2 is measured with a Coulter Counter. The volume average particle diameter D50v is 6.7 μm, the number average particle size distribution index GSDp is 1.31, the volume average particle size distribution index GSDv is 1.23, and the ratio GSDv/GSDp is 0.93.

The shape factor SF1 of the toner particles of Comparative Example 2 obtained by shape observation with a Luzex image analyzer is 119. The toner of Comparative Example 2 has a number average molecular weight Mn of 7,900 and the ratio Mz/Mw of 1.9. The thickness of the shell layer measured from a transmission electron micrograph is 672 nm.

3.5 g of the toner is mixed with 50 g of a ferrite carrier having an average particle diameter of 50 μm, and the mixture is shaken in a tumbler for 30 hours. Thereafter, the toner is measured for D50v, GSDp and SF1, and it is found that D50v is lowered to 6.5 μm and GSDP becomes 1.31. Furthermore, SF1 is lowered to 123, and thus it is found that the toner is broken.

The external additive is added to he toner of Comparative Example 2 in the same manner as in Example 1 to produce a developer, and the test for image formation is carried out by using the developer in the same manner as in Example 1. As a result, the releasing property between the surface of the paper having the image formed thereon and the surface of the fixing roll upon fixing is insufficient, and twining and offset of the image on the fixing roil occur, whereby sufficient evaluation of the image cannot be carried out. The results am shown in Table 1.

Comparative Example 3

A toner is produced in the same manner as in Example 1 except that the using amounts of the resin fine particle dispersions 1 and 2 used for producing the core aggregated particles in Example 1 are changed to 75 parts by weight and 5 parts by weight, respectively, 18 parts by weight of the releasing agent particle dispersion 2 is used instead of the releasing agent particle dispersion 1, and no resin fine particle dispersion is added after producing the core aggregated particles, so as to obtain a toner of Comparative Example 3 having a surface property index of 2.11.

The particle diameter of the toner of Comparative Example 3 is measured with a Coulter Counter. The volume average particle diameter D50v is 6.3 μm, the number average particle size distribution index GSDp is 1.32, the volume average particle size distribution index GSDv is 1.24, and the ratio GSDv/GSD is 0.94.

The shape factor SF1 of the toner particles of Comparative Example 3 obtained by shape observation with a Luzex image analyzer is 117. The toner of Comparative Example 3 has a number average molecular weight Mn of 8,000 and the ratio Mz/Mw of 1.83. It is confirmed from a transmission electron micrograph that no shell layer is formed.

3.5 g of the toner is mixed with 50 g of a ferrite carrier having an average particle diameter of 50 μm, and the mixture is shaken in a tumbler for 30 hours. Thereafter, the toner is measured for D50v, GSDp and SF1, and it is found that D50v is increased to 6.6 μm, and GSDp is deteriorated to 1.34. Furthermore, SF1 is lowered to 120, and thus it is found that the toner is broken.

The equal additive is added to the toner of Comparative Example 3 in the same manner as in Example 1 to produce a developer, and the test for image formation is carried out by using the developer in the same manner as in Example 1. As a result, the releasing property between the surface of the paper having the image formed thereon and the surface of the fixing roll upon fixing is insufficient, and twining and offset of the image on the fixing roll occur, whereby sufficient evaluation of the image cannot be carried out. The results are shown in Table 1.

TABLE 1

| | | Example 1 | Example 2 | Example 3 | Example 4 | Comparative Example 1 | Comparative Example 2 | Comparative Example 4 |
|---|---|---|---|---|---|---|---|---|
| Properties of toner | Mn | 12,100 | 29,400 | 11,200 | 10,400 | 31,300 | 7,900 | 8,000 |
| | Mz/Mw | 3.4 | 5.9 | 3.1 | 3.0 | 6.2 | 1.9 | 1.83 |
| | Thickness of shell layer (nm) | 293 | 210 | 289 | 282 | 525 | 672 | 0 |
| | GSDp | 1.2 | 1.24 | 1.25 | 1.22 | 1.31 | 1.31 | 1.32 |
| | GSDv | 1.18 | 1.18 | 1.21 | 1.23 | 1.23 | 1.23 | 1.24 |
| | GSDv/GSDp | 0.98 | 0.95 | 0.97 | 0.99 | 0.94 | 0.93 | 0.94 |
| | Surface property index | 1.68 | 1.75 | 1.81 | 1.34 | 2.02 | 2.03 | 2.11 |
| | SF1 | 122 | 135 | 125 | 132 | 145 | 119 | 117 |
| | D50v (μm) | 6.4 | 6.4 | 6.6 | 5.8 | 6.7 | 6.7 | 6.3 |
| Evaluation results of test for image formation | Releasing property | good | good | good | good | good | poor | poor |
| | Fixing property | good | good | good | good | poor | — | — |
| | Fogging and scattering of toner | none | none | none | none | occurred | — | — |

In Table 1, the term "good" in the column of releasing property means such a level that releasing upon fixing is smoothly carried out with no practical problem, and the term "poor" means such a level that releasing upon fixing is insufficient to cause a practical problem.

The term "good" in the column of fixing property means such a level that the image suffers no damage by weakly rubbing with nail with no practical problem, and the term "poor" means such a level that the image is damaged by weakly rubbing with nail to cause a practical problem.

As described in the foregoing, the invention can provide a toner for developing electrostatic latent image excellent in releasing property upon fixing and shape controllability upon production of the toner, and a process for producing the toner, and can also provide a process for forming an image, an apparatus for forming an image and a toner catridge, which use the toner for developing electrostatic latent image.

The entire disclosure of Japanese Patent Application No. 2002-276098 filed on Sep. 20, 2002 including specification, claims, drawings and abstract is incorporated herein by reference in its entirety.

What is claimed is:

1. A toner for developing an electrostaic latent image, comprising:

a binder resin; and a colorant, the binder resin having a number average molecular weight Mn in a range of from 10,000 to 30,000 and a ratio (Mz/Mw) of a Z average molecular weight Mz and a weight average molecular weight Mw in a range of from 3.0 to 6.0.

2. The toner for developing an electrostatic latent image as claimed in claim 1, wherein the toner has a volume average particle size distribution index GSDv of 1.30 or less and a ratio (GSDv/GSDp) of a volume average particle size distribution index GSDv and a number average particle size distribution index GSDp of 0.95 or more.

3. The toner for developing an electrostatic latent image as claimed in claim 1, wherein the toner has a surface property index defined by the following equation (1) of 2 or less:

$$\text{(Surface property index)}=\text{(Measured specific surface area)}/\text{(Calculated specific surface area)} \quad (1)$$

wherein the calculated specific surface area is shown by the following equation:

$$6\Sigma(n\times R^2)/(\rho\times\Sigma(n\times R^3))$$

wherein n represents the number of particles in a channel of a Coulter Counter (number per channel), R represents the channel particle diameter in the Coulter Counter (μm), ρ represents the toner density (g/μm$^3$), a divided number of the channels is 16, and an interval of the division is 0.1 in terms of log scale.

4. The toner for developing an electrostatic latent image as claimed in claim 1, wherein the toner has a shape factor SF1 defined by the following equation (2) in a range of from 120 to 135:

$$SF1=ML^2/(4A/\pi)\times 100 \quad (2)$$

wherein ML represents a maximum length of the toner particles (μm), and A represents a projected area of the toner particles (μm$^2$).

5. The toner for developing an electrostatic latent image as claimed in claim 1, further comprising:

a releasing agent having a ratio (η2/η1) of a viscosity at 200° C. η2 and a viscosity at 160 ° C. η1 in a range of from 0.5 to 0.7.

6. The toner for developing an electrostatic latent image as claimed in claim 1, wherein the toner particles have a core/shell structure.

7. The toner for developing an electrostatic latent image as claimed in claim 6, wherein a shell layer has a thickness in a range of from 150 to 300 nm.

8. The toner for developing an electrostatic latent image as claimed in claim 6, where the toner is produced by a process comprising the steps of:

mixing a resin particle dispersion containing first resin particles dispersed therein, a colorant particle dispersion containing colorant particles dispersed therein, and a releasing agent particle dispersion containing releasing agent particles dispersed therein, each of which has a center particle diameter of 1 μm or less, to form core aggregated particles containing the first resin particles, the colorant particles and the releasing agent particles;

forming a shell layer containing second resin particles on a surface of the core aggregated particles to obtain core/shell aggregated particles; and heating the core/shell aggregated particles to a temperature equal to or higher than a glass transition temperature of the first resin particles or the second resin particles to coalesce the core/shell aggregated particles.

9. A process for producing a toner for developing an electrostatic latent image, comprising the steps of:

mixing a resin particle dispersion containing first resin particles dispersed therein, a colorant particle dispersion containing colorant particles dispersed therein and a releasing agent particle dispersion containing releasing agent particles dispersed therein, each of which has a center particle diameter of 1 μm or less, to form a core aggregated particles containing the first resin particles, the colorant particles and the releasing agent particles, the first resin particles having a number average molecular weight Mn in a range of from 10,000 to 30,000 and a ratio (Mz/Mw) of a Z average molecular weight Mz and a weight average molecular weight Mw in a range of from 3.0 to 6.0;

forming a shell layer containing second resin particles on a surface of the core aggregated particles to obtain a core/shell aggregated particles; and heating the core/shell aggregated particles to a temperature equal to or higher than a glass transition temperature of the first resin fine particles or the second resin fine particles to coalesce the core/shell aggregated particles.

10. The process for producing a toner for developing electrostatic latent image as claimed in claim 9, wherein the shell layer has a thickness in a range of from 150 to 300 nm.

11. The process for producing a toner for developing electrostatic latent image as claimed in claim 9, wherein the releasing agent has a ratio ($\eta 2/\eta 1$) of a viscosity at 200° C. $\eta 2$ and a viscosity at 160° C. $\eta 1$ in a range of from 0.5 to 0.7.

12. A process for forming an image comprising the steps of:

charging a surface of a member for holding an image;

forming an electrostatic latent image on the charged surface of the member for holding an image corresponding to image information;

developing the electrostatic latent image formed on the surface of the member for holding an image with a developer containing a toner to obtain a toner image; and fixing the toner image on a surface of a recording medium, the toner having a number average molecular weight Mn in a range of from 10,000 to 30,000 and a ratio (Mz/Mw) of a Z average molecular weight Mz and a weight average molecular weight Mw in a range of from 3.0 to 6.0.

13. The process for forming an image as claimed in claim 12, wherein the fixing step is attained with a heating roll and a pressure roll, and the heating roll has no releasing layer.

14. The process for forming an image as claimed in claim 13, wherein the heating roll is a metallic roll.

15. The process for forming an image as claimed in claim 12, wherein the toner has a volume average particle size distribution index GSDv of 1.30 or less and a ratio (GSDv/GSDp) of a volume average particle size distribution index GSDv and a number average particle size distribution index GSDp of 0.95 or more.

16. An apparatus for forming an image comprising:

a charging unit for charging a surface of a member for holding an image;

an electrostatic latent image forming unit for forming an electrostatic latent image corresponding to image information on the charged surface of the member for holding an image;

a developing unit for developing the electrostatic latent image formed on the surface of the member for holding an image with a developer containing a toner to obtain a toner image; and a fixing unit for fixing the toner image on a surface of a recording medium, the toner having a number average molecular weight Mn in a range of from 10,000 to 30,000 and a ratio (Mz/Mw) of a Z average molecular weight Mz and a weight average molecular weight Mw in a range of from 3.0 to 6.0.

17. The apparatus for forming an image as claimed in claim 16, wherein the fixing unit comprises a heating roll and a pressure roll, and the heating roll has no releasing layers.

18. The apparatus for forming an image as claimed in claim 17, wherein the heating roil is a metallic roll.

19. The apparatus for forming an image as claimed in claim 17, wherein the toner has a volume average particle size distribution index GSDv of 1.30 or less and a ratio (GSDv/GSDp) of a volume average particle size distribution index GSDv and a number average particle size distribution index GSDp of 0.95 or more.

20. A toner cartridge detachably installed in an apparatus for forming an image, the toner cartridge enclosing a toner to be supplied to a developing unit provided in the apparatus for forming an image, the toner having a number average molecular weight Mn in a range of from 10,000 to 30,000 and a ratio (Mz/Mw) of a Z average molecular weight Mz and a weight average molecular weight Mw in a range of from 3.0 to 6.0.

21. The toner cartridge as claimed in claim 20, wherein the toner has a volume average particle size distribution index GSDv of 1.30 or less and a ratio (GSDv/GSDp) of a volume average particle size distribution index GSDv and a number average particle size distribution index GSDp of 0.95 or more.

22. The toner cartridge as claimed in claim 21, wherein the toner further comprises a releasing agent, and the releasing agent has a ratio ($\eta 2/\eta 1$) of a viscosity at 200° C. $\eta 2$ and a viscosity at 160° C. $\eta 1$ in a range of from 0.5 to 0.7.

* * * * *